US008615102B2

(12) United States Patent
Marugami

(10) Patent No.: US 8,615,102 B2
(45) Date of Patent: Dec. 24, 2013

(54) SPEAKER UNIT AND PORTABLE INFORMATION TERMINAL

(75) Inventor: Takashi Marugami, Ibaraki (JP)

(73) Assignee: SANYO Electric Co., Ltd., Moriguchi-shi, Osaka (JP)

( * ) Notice: Subject to any disclaimer, the term of this patent is extended or adjusted under 35 U.S.C. 154(b) by 48 days.

(21) Appl. No.: 13/142,232

(22) PCT Filed: Nov. 11, 2009

(86) PCT No.: PCT/JP2009/069159

§ 371 (c)(1),
(2), (4) Date: Jun. 24, 2011

(87) PCT Pub. No.: WO2010/073837

PCT Pub. Date: Jul. 1, 2010

(65) Prior Publication Data

US 2011/0255734 A1 Oct. 20, 2011

(30) Foreign Application Priority Data

Dec. 25, 2008 (JP) ..... 2008-331417

(51) Int. Cl.
*H04R 25/00* (2006.01)

(52) U.S. Cl.
USPC ..... 381/421; 381/408; 381/398

(58) Field of Classification Search
USPC ..... 381/396, 399, 408, 421, 422, 431, 398
See application file for complete search history.

(56) References Cited

U.S. PATENT DOCUMENTS 4,281,223 A * 7/1981 Ugaji et al. ..... 381/408
6,008,714 A 12/1999 Okuda et al.
6,480,614 B1 11/2002 Denda et al.
6,973,194 B2 * 12/2005 Iwasa et al. ..... 381/412

(Continued)

FOREIGN PATENT DOCUMENTS

JP 9-331596 A 12/1997
JP 3213521 B2 10/2001

(Continued)

OTHER PUBLICATIONS

International Search Report of PCT/JP2009/069159, date of mailing Feb. 2, 2010.

*Primary Examiner* — Davetta W Goins
*Assistant Examiner* — Phylesha Dabney
(74) *Attorney, Agent, or Firm* — Westerman, Hattori, Daniels & Adrian, LLP

(57) ABSTRACT

To provide a speaker unit and a portable information terminal that are reduced in size and thickness and still produce a high sound pressure. A speaker unit includes: a yoke having a rectangular outline as seen in a plan view; a magnet member placed on the yoke and magnetized so that an upper surface of the magnet member has an N pole and an S pole aligned in one direction; a coil placed above and spaced from the upper surface of the magnet member; a diaphragm attached to the coil; and a frame supporting the diaphragm. An engagement protrusion which allows the frame and the yoke to engage with each other is provided on a side which is one of the sides defining the rectangular outline of the yoke and extends along the one direction.

7 Claims, 10 Drawing Sheets

(56) References Cited

U.S. PATENT DOCUMENTS

| | | | | |
|---|---|---|---|---|
| 7,116,796 | B1 * | 10/2006 | Reenberg | 381/431 |
| 7,231,058 | B2 * | 6/2007 | Usuki et al. | 381/412 |
| 7,388,964 | B2 * | 6/2008 | Tomoeda et al. | 381/412 |
| 7,412,065 | B2 * | 8/2008 | Nguyen et al. | 381/152 |
| 7,912,239 | B2 * | 3/2011 | Nishimura et al. | 381/396 |
| 8,031,902 | B2 * | 10/2011 | Takewa | 381/431 |
| 8,094,864 | B2 * | 1/2012 | Inaba et al. | 381/398 |
| 2009/0034751 | A1 * | 2/2009 | Takewa | 381/86 |

FOREIGN PATENT DOCUMENTS

| | | | |
|---|---|---|---|
| JP | 2004-072647 | A | 3/2004 |
| JP | 2004-180193 | A | 6/2004 |
| WO | 99/03304 | A1 | 1/1999 |

* cited by examiner

SPEAKER UNIT AND PORTABLE INFORMATION TERMINAL

TECHNICAL FIELD

The present invention relates to a speaker unit and a portable information terminal, and particularly relates to a speaker unit and a portable information terminal that are reduced in size and thickness.

BACKGROUND ART

Speaker units are used in portable information terminals such as mobile phone, DSC (Digital Still Camera), PDA (Personal Digital Assistant), and PC (Personal Computer). A speaker unit herein includes a so-called speaker and a receiver.

An electroacoustic transducer (speaker unit) has been proposed that has a flat-shaped coil (horizontal coil) wound in such a manner that the number of coil layers in the width direction is larger than the number of coil layers in the thickness direction so as to reduce the size and the thickness (see for example Japanese Patent No. 3213521: Patent Document 1).

Patent Document 1: Japanese Patent No. 3213521

DISCLOSURE OF THE INVENTION

Problems to be Solved by the Invention

Recently, portable information terminals such as mobile phone, DSC (Digital Still Camera), PDA (Personal Digital Assistant), and PC (Personal Computer) have been reduced rapidly in size and thickness. Accordingly, the space occupied by the speaker unit used in the portable information terminal continues being reduced. There is thus an increasing need for use of a speaker unit which occupies a smaller space and exhibits higher performance. Particularly, because of a large influence of a reduced sound pressure resultant from the reduced size and thickness, expectations are rising for a speaker unit and a portable information terminal that are structured to have a smaller size and a smaller thickness and still exhibit high sound pressure performance.

In order to improve the sound pressure of a speaker unit having a horizontal coil, it is effective to upsize a magnetic body placed opposite to the coil.

Meanwhile, in order to prevent magnetic flux leakage from the magnetic body to the outside of the device, the bottom of the magnetic body may be covered with a yoke.

In the case where the yoke is used, however, it is necessary to attach the yoke to a frame and it is also necessary to provide the yoke with an attachment for attaching the yoke to the frame. If such an attachment is provided to the yoke, the space occupied by the attachment and the space for engagement of the attachment and the frame with each other for example will limit upsizing of the magnetic body. The limited upsizing of the magnetic body makes it difficult to improve the sound pressure of the speaker unit.

The present invention has been made in view of the problems above, and an object of the invention is to provide a speaker unit and a portable information terminal that are reduced in size and thickness and still produce a high sound pressure.

Means for Solving the Problems

A speaker unit of the present invention includes: a yoke which has a rectangular outline as seen in a plan view; a magnet member which is placed on the yoke and magnetized so that an upper surface of the magnet member has an N pole and an S pole aligned in one direction; a coil which is placed above and spaced from the upper surface of the magnet member; a diaphragm which is attached to the coil; and a frame which supports the diaphragm. An engagement protrusion which allows the frame and the yoke to engage with each other is provided on a side which is one of sides defining the rectangular outline of the yoke and extends along the one direction.

The speaker unit of the present invention has an engagement protrusion on a side which extends along the one direction. The engagement protrusion can improve the strength of joint between the frame and the yoke, and therefore, no engagement portion for the inside of the yoke and the frame is necessary on the side which crosses the one direction. Thus, the dimension along the one direction of the magnet member is not limited by engagement of the yoke and the frame. The dimension of the magnet member can therefore be increased along the one direction.

Since the magnet member has the N and S poles aligned in the one direction, the dimension in the one direction of the magnet member can be increased so as to increase the number of magnetic fluxes from the N pole toward the S pole. In this way, the number of magnetic fluxes passing through the coil can be increased and accordingly the sound pressure can be improved.

Further, between the magnet member and the engagement protrusion, magnetic fluxes are formed in the direction crossing the one direction, and accordingly, the magnetic efficiency can be improved.

Preferably, in the above-described speaker unit, the engagement protrusion has a bent portion which is bent outward.

This bent portion enables the yoke to be joined more firmly to the frame, and the joint strength between the yoke and the frame can be improved.

Preferably, in the above-described speaker unit, the yoke has a protrusion on a side which is one of the sides defining the rectangular outline of the yoke and crosses the one direction, and the protrusion has a recess on a central portion of the side which crosses the one direction.

Thus, no magnetic flux is directed through the recess of the yoke to the upper surface of the magnet member. Therefore, in a region of the magnet member that is located adjacent to the recess, the number of magnetic fluxes on the upper surface of the magnet member can be increased. In this way, the number of magnetic fluxes passing through the coil can be increased and the sound pressure can accordingly be improved.

Preferably, in the above-described speaker unit, the magnet member is made up of a plurality of magnetic bodies including a first magnetic body having an upper surface magnetized to an N pole and a second magnetic body having an upper surface magnetized to an S pole.

In this way, the horizontal component of the high-density magnetic fluxes on the upper surface of the magnet member can be used to drive the horizontal coil.

Preferably, in the above-described speaker unit, the magnet member is formed of a single magnetic body with an upper surface having an N pole and an S pole.

In this way, the number of components can be reduced, which enables reduction in production cost and improvement in productivity including the production time for example.

Preferably, in the above-described speaker unit, the coil is one of a rectangle coil, an elliptical coil, a running-track-shaped coil, and a polygonal coil.

The degree of freedom in design can thus be improved.

A portable information terminal of the present invention includes any speaker unit as described above.

The portable information terminal of the present invention includes any speaker unit as described above, and therefore, the size and thickness of the portable information terminal can be reduced and the sound pressure such as voice and ringtone can be improved.

Effects of the Invention

As seen from the foregoing description, the speaker unit and the portable information terminal of the present invention enable reduction in size and thickness as well as increase in sound pressure.

BEST MODES FOR CARRYING OUT THE INVENTION

Embodiments of the present invention will hereinafter be described with reference to the drawings.

First Embodiment

First, a configuration of a speaker unit in the present embodiment will be described.

FIG. 1 is a schematic cross section showing the configuration of the speaker unit in the first embodiment of the present invention. FIG. 2 is a schematic plan view of the speaker unit shown in FIG. 1. FIG. 2 does not show a diaphragm and a frame cover for the sake of facilitating visual perception. A schematic cross section along a line I-I in FIG. 2 is shown in FIG. 1.

Referring to FIGS. 1 and 2, the speaker unit of the present embodiment mainly includes a yoke 1, a magnet member 2, a coil 3, a diaphragm 4, a frame 5, a frame cover 10, and a protrusion 6. Yoke 1 as shown in FIG. 2 has a rectangular outline as seen in a plan view.

Magnet member 2 is placed on and in contact with yoke 1. Magnet member 2 is magnetized so that an upper surface has an S pole, an N pole, and an S pole that are aligned in this order along the X direction (one direction) in the drawings, and a lower surface has an N pole, an S pole, and an N pole aligned in this order along the X direction.

Magnet member 2 has for example a plurality of magnetic bodies 21, 22. By way of example, a central portion 21 (first magnetic body) of magnet member 2 is formed of a magnet magnetized so that the upper surface is an N pole and the lower surface is an S pole. On the contrary, opposite end portions 22 (second magnetic bodies) of magnet member 2 are each formed of a magnet magnetized so that the upper surface is an S pole and the lower surface is an N pole. Magnet member 2 is placed in such a manner that allows the outer sides of opposite end portions 22 of magnet member 2 to contact the inner sides of protrusions 6.

Coil 3 is placed above and spaced from the upper surface of magnet member 2. This coil 3 is a flat-shaped coil (horizontal coil) in that the number of coil layers in the width direction (X or Y direction in FIGS. 1 and 2) is larger than that in the thickness direction (Z direction in FIG. 1). Coil 3 is placed so that a magnetic flux produced by magnet member 2 passes across coil 3.

The linear portions of the contour of coil 3 as seen in a plan view are located above the boundaries between central portion 21 and opposite end portions 22 of magnet member 2. In the case of the horizontal coil, the magnetic flux in the direction along the upper surface of magnet member 2 drives coil 3. The density of magnetic fluxes in the direction along the upper surface of magnet member 2 is at its maximum on the boundaries between central portion 21 and opposite end portions 22 of magnet member 2. Thus, the linear portions of coil 3 can be arranged above the boundaries between central portion 21 and opposite end portions 22 of magnet member 2 to drive coil 3 with the maximum magnetic flux density.

A magnetic circuit is formed by the above-described yoke 1, magnet member 2, and coil 3. Magnetic fluxes X1, X2 are directed from the N pole of the upper surface of central portion 21 of magnet member 2 to the S poles of respective upper surfaces of opposite end portions 22, so that the magnetic fluxes pass through coil 3 above the upper surface of magnet member 2. Further, between opposite end portions 22 of magnet member 2 and protrusions 6 of yoke 1, magnetic fluxes X3, X4 are directed from the N poles of the lower surfaces of opposite end portions 22 of the magnet member through protrusions 6 of yoke 1 to the S poles of the upper surfaces of the same opposite end portions 22. Furthermore, as shown in FIG. 2, between central portion 21 of magnet member 2 and engagement protrusions 7 of yoke 1, magnetic fluxes X5, X6 are directed from the N pole of the upper surface of central portion 21 of magnet member 2 through engagement protrusions 7 of yoke 1 to the S pole of the lower surface of the same central portion 21.

Diaphragm 4 has a lower surface to which coil 3 is attached. Diaphragm 4 is formed of a thin plate so that it can vibrate in the up and down direction (Z direction). Diaphragm 4 is made for example of a synthetic resin. The outer periphery of this diaphragm 4 is supported by frame 5.

FIG. 3 is a schematic perspective view of the yoke in the present embodiment. FIG. 4 is a schematic perspective view of the yoke and the magnet member in the present embodiment. Referring to FIGS. 3 and 4, yoke 1 has protrusion 6 on the side along the direction (Y direction) which crosses the direction along which the S pole, the N pole, and the S pole of the upper surface of magnet member 2 are aligned. This protrusion 6 stands from the side of yoke 1 in the upward direction (Z direction) as seen in the drawings.

Yoke 1 also has engagement protrusion 7 on the side along the direction (X direction) along which the S pole, the N pole, and the S pole of the upper surface of magnet member 2 are aligned. This engagement protrusion 7 stands from the side of yoke 1 in the upward direction (Z direction) as seen in the drawings. Like protrusion 6, this engagement protrusion 7 is an attachment for attaching yoke 1 to frame 5. Engagement protrusions 7 are formed respectively on the two sides along the one direction of yoke 1. Further, engagement protrusions 7 are each formed at a central part of the side along the one direction of yoke 1.

FIG. 5 is a schematic perspective view of the yoke and the frame in the present embodiment. FIG. 6 is a schematic cross section along a line VI-VI in FIG. 5. Referring to FIGS. 5 and 6, engagement protrusion 7 of yoke 1 is fit in a hole of frame 5 and supported by frame 5 from the opposite sides of engagement protrusion 7 to thereby join yoke 1 to frame 5.

Yoke 1 and frame 5 are assembled for example by insert molding. Specifically, assembly is performed by injecting a resin into a mold in which yoke 1 is held so that frame 5 is made of the resin. Consequently, frame 5 is molded to allow the resin to surround the outsides of protrusions 6 and the peripheries of engagement protrusions 7 of yoke 1. Frame 5, however, is not formed inside protrusions 6 of yoke 1.

Frame cover 10 is placed to cover diaphragm 4. Frame cover 10 is formed toward the upper surface in the shape of a trapezoid having one pair of parallel sides. Frame cover 10 is attached to frame 5 with diaphragm 4 interposed therebetween, so that the upper surface of the outer periphery of diaphragm 4 is opposite to the lower surface of the outer periphery of frame cover 10. No frame cover 10 may be provided so that diaphragm 4 is not covered.

The speaker unit of the present embodiment is configured in the above-described manner.

While the foregoing description is given of magnet member 2 having magnets that are arranged as central portion 21 and opposite end portions 22 of magnet member 2, magnet member 2 may be the one having a ferromagnetic body (first magnetic body) as central portion 21 and magnets arranged as opposite end portions 22 on the opposite sides of this ferromagnetic body (first magnetic body). The magnets (second magnetic bodies) located on the opposite sides of the ferromagnetic body (first magnetic body) each may be formed of a magnet magnetized so that the upper surface is an S pole and the lower surface is an N pole.

Further, the positional relation between the first magnetic body and the second magnetic body may be opposite to that in the above-described configuration. Specifically, central portion 21 of magnet member 2 may be the second magnetic body with the polarity that the upper surface is an S pole and the lower surface is an N pole, and the opposite end portions 22 may be first magnetic bodies each having the polarity that the upper surface is an N pole and the lower surface is an S pole.

Moreover, while the foregoing description is of magnet member 2 having central portion 21 and opposite end portions 22 that are identical in length as seen in a plan view, magnet member 2 may have central portion 21 longer than opposite end portions 22 as seen in a plan view. In this way, the magnetic flux density between central portion 21 of magnet member 2 and engagement protrusions 7 can be improved.

Furthermore, while the foregoing description is of magnet member 2 made up of a plurality of magnetic bodies, magnet member 2 may be a single magnetic body with the upper surface having an N pole and an S pole. This configuration will be described in the following. FIG. 7 is a schematic perspective view of the yoke and a magnet member formed of a single magnetic body in the present embodiment. Referring to FIG. 7, magnet member 2 is formed of a single magnetic body magnetized to have multiple poles. Magnet member 2 has, like above-described magnet member 2 having a plurality of magnetic bodies 21, 22, a central portion 21 and opposite end portions 22, and central portion 21 has its polarity opposite to that of opposite end portions 22. For example, central portion 21 has a polarity that the upper surface is an N pole and the lower surface is an S pole, and opposite end portions 22 each have a polarity that the upper surface is an S pole and the lower surface is an N pole. Since a single magnetic body which is magnetized to have multiple poles is used as magnet member 2, the number of components can be decreased and accordingly the production cost can be reduced, and the productivity including the production time for example can be improved, as compared with the case where a plurality of magnetic bodies are used.

Regarding the shape of coil 3, while the foregoing description is of coil 3 in the shape of a running track as seen in a plan view, coil 3 may be any of a rectangle coil, an elliptical coil, a running-track-shaped coil, and a polygonal coil. The degree of freedom in design can thus be enhanced. FIG. 8 (A) to (D) is a schematic plan view showing coil shapes. FIG. 8 (A) shows a rectangle coil which is rectangular as seen in a plan view, and has the longer sides and the shorter sides connected into the shape of a rectangle. FIG. 8 (B) shows an elliptical coil which is formed in the shape of an ellipse having its major axis and minor axis as seen in a plan view. FIG. 8 (C) shows a running-track-shaped coil having linear portions as seen in a plan view. FIG. 8 (D) shows a polygonal coil formed in the shape of a polygon made up of a plurality of linear portions as seen in a plan view.

An operation of the speaker unit in the present embodiment will now be described.

The above-described configuration allows magnetic fluxes generated from magnet member 2 to be converged to a gap where coil 3 is located, and a magnetic field is generated. As a current flows in coil 3, the current flowing in coil 3 and the magnetic field generated from magnet member 2 cause coil 3 to vibrate up and down based on the Fleming's left-hand rule. Thus, diaphragm 4 attached to coil 3 vibrates as well. Accordingly, the electrical signal (current) is converted into sound (vibration).

Next, the functions and effects of the speaker unit of the present embodiment will be described in comparison with another speaker unit.

As described above, in order to prevent a magnetic flux from magnet member 2 from leaking to the outside of the speaker unit, it is necessary to provide yoke 1 which covers the whole lower surface of magnet member 2. Yoke 1 is formed for example of a metal having a high magnetic permeability, and is therefore difficult to be processed into a complicated shape by bending or the like. Thus, yoke 1 and frame 5 may be provided separately and frame 5 may be formed for example of a resin so as to form frame 5 into a complicated shape. Further, frame 5 may be formed of a resin so as to have a reduced weight. In the case where yoke 1 is thus provided separately from frame 5, it is necessary to secure yoke 1 to frame 5. It is therefore required to provide yoke 1 with an attachment for attaching the yoke to frame 5.

Here, in the case where the upper surface of magnet member 2 has the N and S poles aligned in the X direction as shown in FIGS. 1 and 2, magnet member 2 is usually designed so that the dimension in the Y direction is longer than the dimension in the X direction. This is for the reason that the longer dimension in the Y direction of magnet member 2 enables increase in the number of magnetic fluxes X1, X2 from the N pole toward the S poles of the upper surface of magnet member 2.

Therefore, in the case where a high joint strength between yoke 1 and frame 5 is desired, an attachment to frame 5 may be provided along the whole longer side (the side along the Y direction) of yoke 1. In other words, the attachment can be provided on the longer side so as to provide a large joint and thereby increase the joint strength.

FIGS. 9 and 10 are respectively a schematic cross section and a schematic plan view showing a configuration where protrusions serving as attachments to the frame are provided respectively along the whole longer sides (the sides along the Y direction) of the yoke. FIG. 10 does not show the diaphragm and the frame cover for the sake of facilitating visual perception. A schematic cross section along a line XI-XI in FIG. 10 is shown in FIG. 9. FIG. 11 is a schematic cross section along a line connecting respective centers of the shorter sides (the sides along the X direction) of the yoke configured in the manner as shown in FIGS. 9 and 10.

Referring to FIGS. 9 and 10, on the sides along the Y direction of yoke 1 of this speaker unit, protrusions 6 for allowing frame 5 and yoke 1 to engage with each other are formed. This yoke 1 has protrusion 6 with its opposite sides (inside and outside) held in frame 5, and is thereby supported. It is accordingly required to provide, between protrusion 6 and magnet member 2, a space (gaps G1, G2) for allowing a part of frame 5 to be inserted. Because of the need to provide this space, the dimension L in the X direction of magnet member 2 is limited and accordingly smaller.

Here, as the dimension in the X direction of magnet member 2 is smaller, the number of magnetic fluxes X1, X2 (FIG. 10) from the N pole toward the S poles of the upper surface of magnet member 2 is smaller. The number of magnetic fluxes crossing coil 3 is thus smaller, resulting in a reduced sound pressure.

Referring to FIG. 11, this speaker unit does not have attachments formed on the shorter sides (the sides along the X direction) of yoke 1, and therefore frame 5 is not supported on the shorter sides of yoke 1.

In contrast, the speaker unit in the present embodiment is provided with engagement protrusions 7 on the sides along the one direction (X direction). Engagement protrusions 7 improve the joint strength between frame 5 and yoke 1. In this way, a sufficient joint strength can be ensured together with coupling between the outsides of protrusions 6 of yoke 1 and frame 5, and gaps G1, G2 can be eliminated. Therefore, the dimension in the one direction (X direction) of magnet member 2 is not limited by engagement of yoke 1 and frame 5 with each other. In this way, the dimension in the one direction (X direction) of magnet member 2 can be increased to the dimension between respective inner longer sides of yoke 1.

Magnet member 2 has the N and S poles aligned in the one direction (X direction), and therefore, the dimension in the one direction of magnet member 2 can be made larger to increase the number of magnetic fluxes from the N pole toward the S poles. In this way, the number of magnetic fluxes passing through the coil can be increased to thereby improve the sound pressure.

Further, since magnetic fluxes X5, X6 are formed between central portion 21 of magnet member 2 and engagement protrusions 7 of yoke 1, the magnetic efficiency can be improved. The sound pressure can thus be improved.

Second Embodiment

First, a configuration of a speaker unit in the present embodiment will be described.

FIG. 12 is a schematic perspective view of a yoke used for the speaker unit in the second embodiment of the present invention. Referring to FIG. 12, the speaker unit of the present embodiment chiefly differs from that of the first embodiment in that an engagement protrusion 7 of yoke 1 is bent outward to have a bent portion 8.

FIG. 13 is a schematic perspective view of the yoke and a magnet member in the present embodiment. Referring to FIG. 13, magnet member 2 made up of a plurality of magnetic bodies including a first magnetic body with the upper surface magnetized to an N pole and a second magnetic body with the upper surface magnetized to an S pole is placed on yoke 1.

FIG. 14 is a schematic perspective view of the yoke and a frame in the present embodiment. FIG. 15 is a schematic cross section along a line XV-XV in FIG. 14. Referring to FIGS. 14 and 15, the upper surface of bent portion 8 of engagement protrusion 7 is located to be substantially coplanar with the upper surface of one step of frame 5. Along the upper surface of the one step of frame 5, engagement protrusion 7 has bent portion 8 which is bent outward, and therefore, the hole in which engagement protrusion 7 is fit is opened larger by the upper surface of bent portion 8, as compared with the first embodiment.

FIG. 16 is a schematic perspective view of the yoke and a magnet member formed of a single magnetic body in the present embodiment. Referring to FIG. 16, magnet member 2 formed of a single magnetic body with the upper surface having N and S poles may be placed on yoke 1.

The configuration of the present embodiment except for the features above is similar to the above-described configuration of the first embodiment, and therefore the same components are denoted by the same reference characters and the description thereof will not be repeated.

Next, the functions and effects of the speaker unit in the present embodiment will be described.

The speaker unit in the present embodiment is configured in the above-described manner and therefore has the functions and effects similar to those of the first embodiment.

Further, the speaker unit in the present embodiment includes engagement protrusion 7 having bent portion 8 which is bent outward. Bent portion 8 is formed in frame 5 by insert molding. Consequently, yoke 1 is held more strongly in the Y direction, and is held in the Z direction as well. In this way, yoke 1 can more firmly be joined to frame 5, and the joint strength between yoke 1 and frame 5 can be improved.

Third Embodiment

First, a configuration of a speaker unit in the present embodiment will be described.

FIG. 17 is a schematic cross section showing the configuration of the speaker unit in the third embodiment of the present invention. FIG. 18 is a schematic plan view of the speaker unit shown in FIG. 17. FIG. 18 does not show the diaphragm and the frame cover for the sake of facilitating visual perception. A schematic cross section along a line XVII-XVII in FIG. 18 is shown in FIG. 17.

Referring to FIGS. 17 and 18, the speaker unit of the present embodiment chiefly differs from the second embodiment in that protrusion 6 of yoke 1 has a recess 9 in its central portion. Opposite end portions 22 of magnet member 2 do not contact protrusions 6 along the portions adjacent to recesses 9.

FIG. 19 is a schematic perspective view of the yoke in the present embodiment. Referring to FIG. 19, yoke 1 has protrusion 6 on a side which crosses the one direction (X direction), among the sides defining the rectangular outline of yoke 1. Protrusion 6 has recess 9 in its central portion. The central portion of protrusion 6 is an intermediate portion along the longitudinal direction of protrusion 6.

FIG. 20 is a schematic perspective view of the yoke and magnetic bodies in the present embodiment. Referring to FIG. 20, the outsides of the four corners of magnet member 2 are arranged to contact the insides of protrusions 6 of yoke 1.

FIG. 21 is a schematic perspective view of the yoke and a frame in the present embodiment. A cross section along a line XV-XV in FIG. 21 is shown in FIG. 15. Referring to FIG. 21, frame 5 is formed so that it fits in recess 9 of protrusion 6 along the direction (Y direction) crossing the one direction. Further, the inside of frame 5 and the inside of protrusion 6 of yoke 1 are formed to be substantially coplanar with each other.

FIG. 22 is a schematic perspective view of the yoke and a magnet member formed of a single magnetic body in the present embodiment. Referring to FIG. 22, magnet member 2 may be formed of a single magnetic body with its upper surface having N and S poles.

The configuration of the present embodiment except for the above-described features is similar to the above-described second embodiment, and therefore, the same components are denoted by the same reference characters and the description thereof will not be repeated.

Like the first embodiment, engagement protrusion 7 may be in the shape without bent portion 8.

Further, magnet member 2 may be formed with a width that is enough for the magnet member to be placed on recesses 9. In this way, the dimension of magnet member 2 can be increased in the one direction and therefore the sound pressure can be increased.

Next, the functions and effects of the speaker unit in the present embodiment will be described.

The speaker unit in the present embodiment has the above-described configuration and therefore has similar functions and effects to those of the first embodiment.

Further, the speaker unit in the present embodiment includes engagement protrusion 7 having bent portion 8 which is bent outward, and therefore has similar functions and effects to those of the second embodiment.

In the following, functions and effects of the speaker unit of the present embodiment will be described in comparison with another speaker unit. Referring to FIGS. 9 and 10, in the case where protrusion 6 of yoke 1 does not have recess 9, magnetic fluxes X3, X4 are directed as shown in FIG. 9 from respective lower surfaces of opposite end portions 22 of magnet member 2 to the upper surface of magnet member 2, by yoke 1 and protrusions 6.

In contrast, the speaker unit of the present embodiment is provided with recesses 9 which are each located in a central portion of protrusion 6 of yoke 1. Therefore, in recesses 9, magnetic fluxes X3, X4 are not directed from respective lower surfaces of opposite end portions 22 of magnet member 2 through yoke 1 and protrusions 6 to the upper surface of magnet member 2. Thus, in the regions adjacent to recesses 9 of magnet member 2, the number of magnetic fluxes on the upper surface of magnet member 2 can be increased. In this way, the number of magnetic fluxes passing through the coil can be increased and thereby the sound pressure can be improved.

If protrusions 6 of yoke 1 do not have recesses 9, as shown in FIG. 9, magnetic fluxes X3, X4, which are directed by yoke 1 and protrusions 6 from respective lower surfaces of opposite end portions 22 of magnet member 2, and magnetic fluxes X1, X2, which are directed from the N pole to the S poles on the upper surface of magnet member 2, cancel each other. Thus, magnetic fluxes X1 and X3 cancel each other and magnetic fluxes X2 and X4 cancel each other to cause a loss of the magnetic fluxes, resulting in reduction in magnetic efficiency of the magnetic fluxes in the direction along the upper surface of magnet member 2.

In contrast, the speaker unit of the present embodiment is provided with recesses 9 in central portions of protrusions 6 of yoke 1. Accordingly, on the upper surface of magnet member 2, cancellation with each other of the magnetic flux in the vicinity of the boundary between the N pole and the S pole on the upper surface of magnet member 2 and the magnetic flux directed by magnet member 2 and yoke 1 can be suppressed, and the magnetic efficiency of the magnetic fluxes in the direction along the upper surface of magnet member 2 can be improved. In this way, the sound pressure can be improved.

In the case of the horizontal coil, magnetic fluxes X3, X4 between opposite end portions 22 of magnet member 2 and protrusions 6 of yoke 1 do not function effectively for driving coil 3. Therefore, it is more desirable that no protrusions 6 of yoke 1 are formed outside opposite end portions 22 of magnet member 2.

Recess 9 may have a length corresponding to the linear portion as seen in a plan view of the outline of coil 3. The horizontal coil is driven chiefly by the magnetic fluxes between the linear portion as seen in a plan view of the outline of coil 3 and the vicinity of the boundary between the N pole and the S pole on the upper surface of magnet member 2. Therefore, the length of recess 9 can be the length corresponding to the linear portion as seen in a plan view of the outline of coil 3 to improve the magnetic efficiency. In this way, the sound pressure can be improved.

In this case, yoke 1 and frame 5 are assembled by forming protrusions 6 in frame 5 by insert molding. Since protrusions 6 are thus formed, the joint strength between yoke 1 and frame 5 can be improved.

In the case where the above-described rectangle coil is used as coil 3, the length corresponding to the linear portion as seen in a plan view of this rectangle coil may be the length of recess 9 of protrusion 6. In the case where the above-described running-track-shaped coil is used as coil 3, the length corresponding to the linear portion as seen in a plan view of the running-track-shaped coil may be the length of recess 9 of protrusion 6.

A magnetic flux between a round portion as seen in a plan view of the outline of coil 3 and protrusion 6 of yoke 1 does not function effectively for driving coil 3. Therefore, protrusion 6 of yoke 1 may be formed in the vicinity of the round portion as seen in a plan view of the outline of coil 3 to prevent decrease in magnetic efficiency.

Fourth Embodiment

First, a configuration of a portable information terminal in the present embodiment will be described.

FIGS. 23 and 24 are each a schematic perspective view of the portable information terminal in the fourth embodiment of the present invention. Referring to FIGS. 23 and 24, the portable information terminal in the present embodiment is a mobile phone that mainly includes an upper casing 101, a display unit 102, a sound emission hole 103, a hinge portion 104, a lower casing 105, an operation button 106, a numeric button 107, a display unit 111, a sound emission hole 112, and any of the speaker units of the first to the third embodiments (not shown).

Referring to FIG. 23, a surface of upper casing 101 is provided with display unit 102. On one end of the surface of upper casing 101, sound emission hole 103 is formed. On the other end of upper casing 101, hinge portion 104 is formed. On one end of lower casing 105, hinge portion 104 is formed. Hinge portion 104 couples upper casing 101 and lower casing 105 to each other so that they can be opened and closed. A surface of lower casing 105 has operation button 106 formed to the side of hinge portion 104. Numeric button 107 is formed opposite to hinge portion 104, with respect to operation button 106.

Referring to FIG. 24, the rear surface of upper casing 101 is provided with display unit 111. Sound emission hole 112 is formed to the side of display unit 111.

The speaker unit which is any of the speaker units of the first to third embodiments (not shown) is provided in upper casing 101. With this speaker unit, the sound is emitted from the speaker unit mainly through sound emission holes 103 and 112 to the outside of the portable information terminal.

Next, the functions and effects of the portable information terminal in the present embodiment will be described.

The portable information terminal in the present embodiment includes any of the speaker units of the above-described first to third embodiments, and therefore, reduction in size and thickness of the portable information terminal can be achieved and the sound pressure such as voice and ringtone can be improved.

In other words, the portable information terminal in the present embodiment that achieves reduction in size and thickness can be a smaller-sized portable information terminal. Further, use of a space-saving speaker unit can improve the degree of freedom in design. Moreover, the sound pressure can be increased to clearly distinguish the voice and ringtone for example.

While the foregoing description of each embodiment is about a mobile phone as a portable information terminal, the portable information terminal is not limited to this and may be DSC, PDA, PC or the like.

The speaker unit of the present invention may be configured by combining respective configurations of the above-described embodiments as appropriate.

It should be construed that the embodiments disclosed herein are by way of illustration in all respects, not by way of limitation. It is intended that the scope of the present invention is defined by claims, not by the above description, and encompasses all modifications and variations equivalent in meaning and scope to the claims.

INDUSTRIAL APPLICABILITY

The present invention is advantageously applicable particularly to speaker units and portable information terminals reduced in size and thickness.

DESCRIPTION OF THE REFERENCE SIGNS

Figure 1:
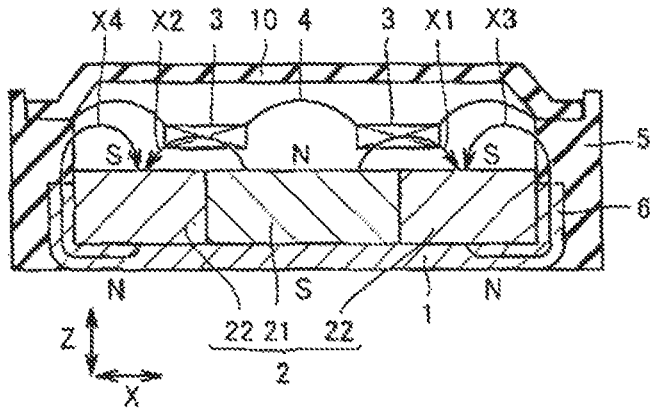
FIG. 1 is a schematic cross section of a speaker unit in a first embodiment.
Figure 2:
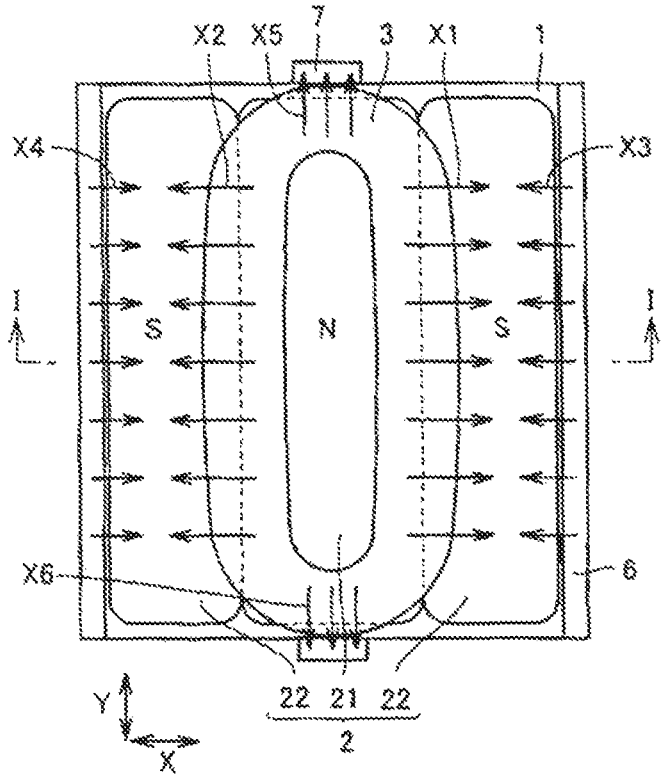
FIG. 2 is a schematic plan view of the speaker unit in the first embodiment.
Figure 3:
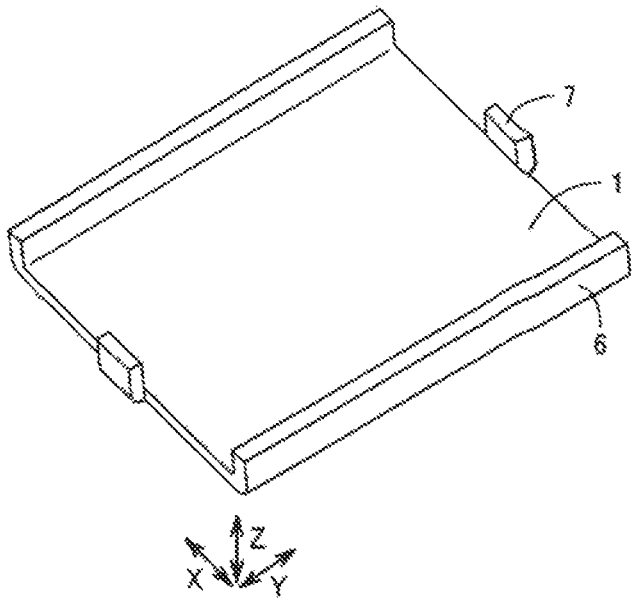
FIG. 3 is a schematic perspective view of a yoke of the speaker unit in the first embodiment.
Figure 4:
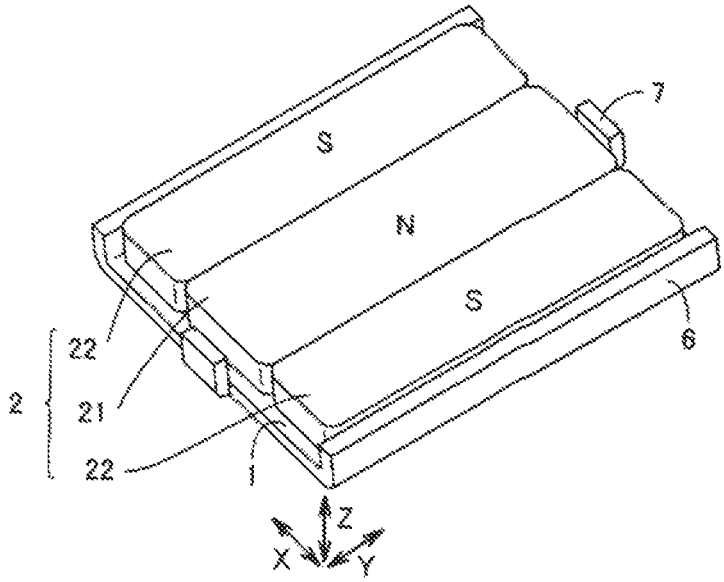
FIG. 4 is a schematic perspective view of the yoke and a magnet member of the speaker unit in the first embodiment.
Figure 5:
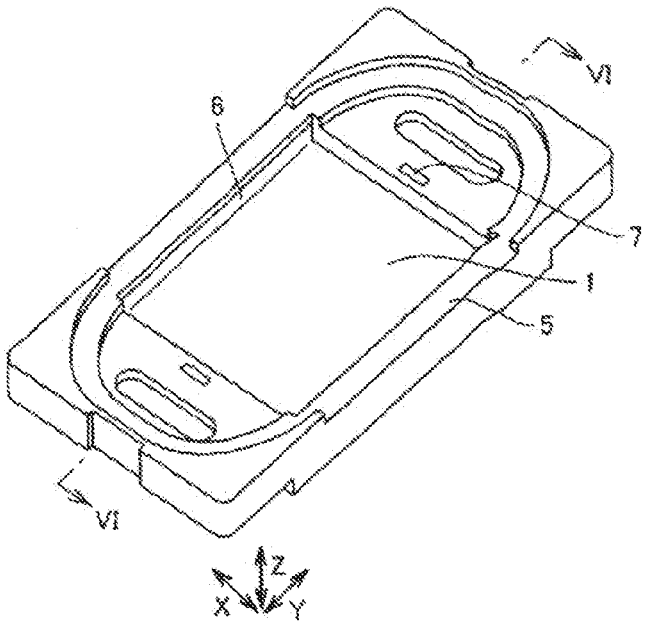
FIG. 5 is a schematic perspective view of the yoke and a frame of the speaker unit in the first embodiment.
Figure 6:
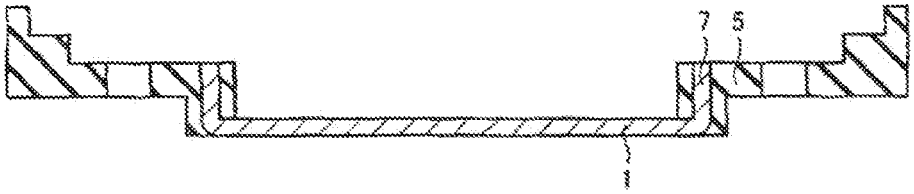
FIG. 6 is a schematic cross section of the yoke and the frame of the speaker unit in the first embodiment.
Figure 7:
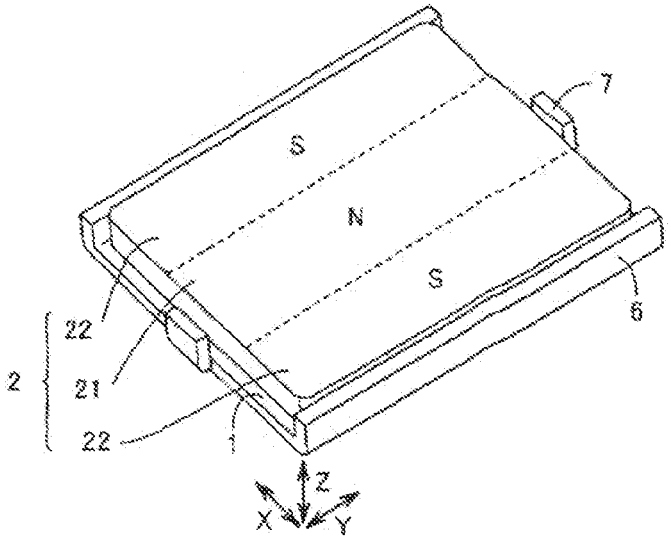
FIG. 7 is a schematic perspective view of the yoke and a magnet member of the speaker unit in the first embodiment.
Figure 8:
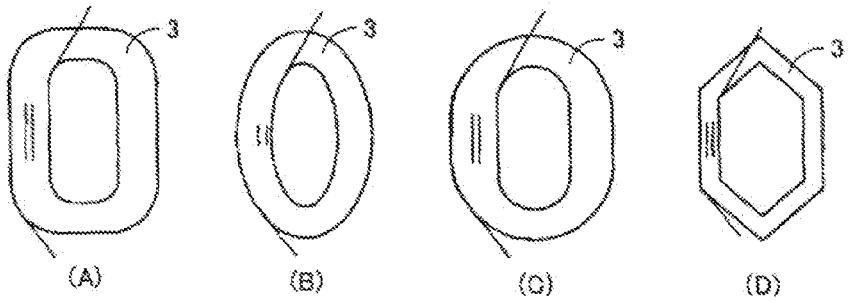
FIG. 8 is a schematic plan view of a coil of the speaker unit in the first embodiment.
Figure 9:
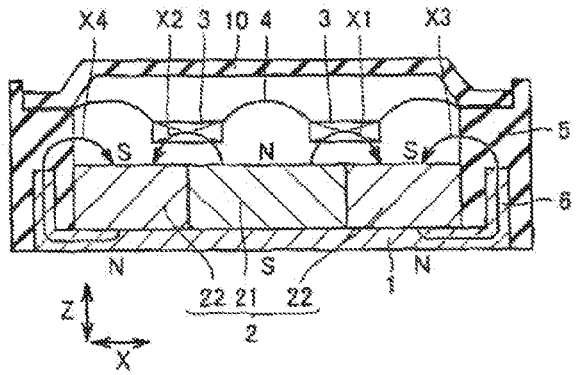
FIG. 9 is a schematic cross section of another speaker unit for comparison's sake.
Figure 10:
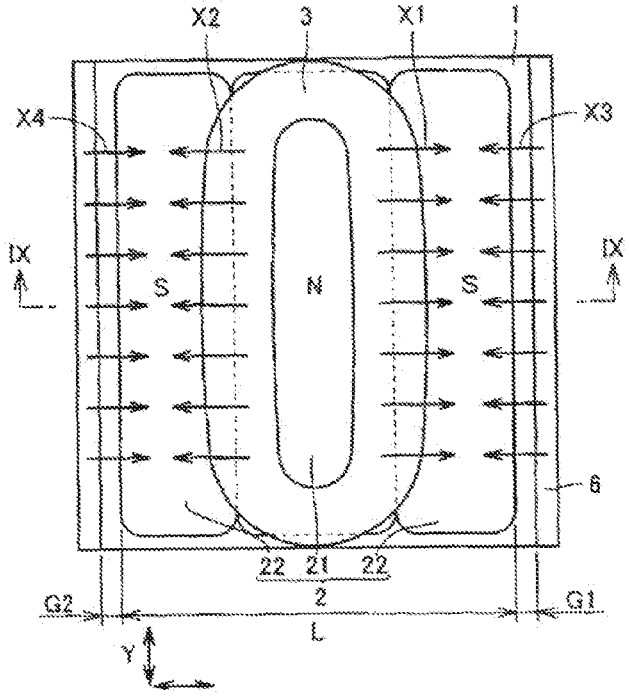
FIG. 10 is a schematic plan view of another speaker unit for comparison's sake.
Figure 11:
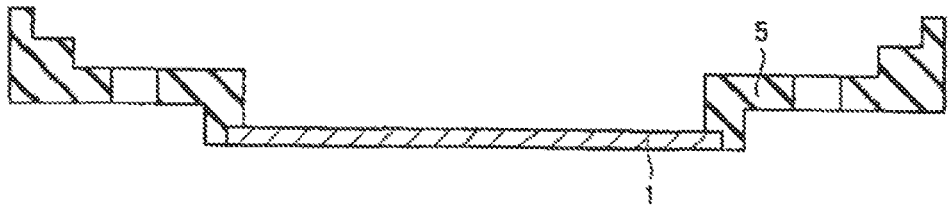
FIG. 11 is a schematic cross section of a yoke and a frame of another speaker unit for comparison's sake.
Figure 12:
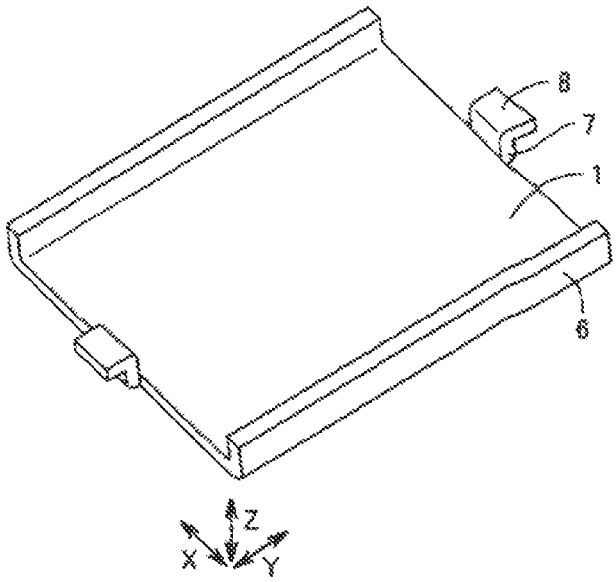
FIG. 12 is a schematic perspective view of a yoke of a speaker unit in a second embodiment.
Figure 13:
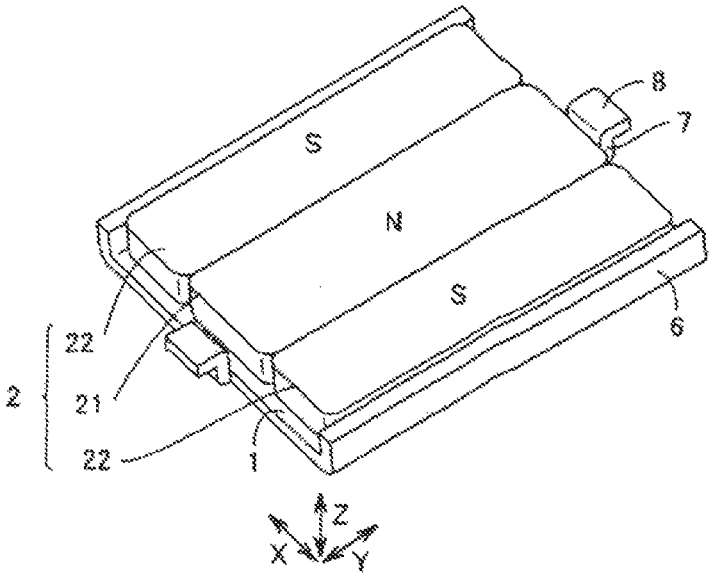
FIG. 13 is a schematic perspective view of the yoke and a magnet member of the speaker unit in the second embodiment.
Figure 14:
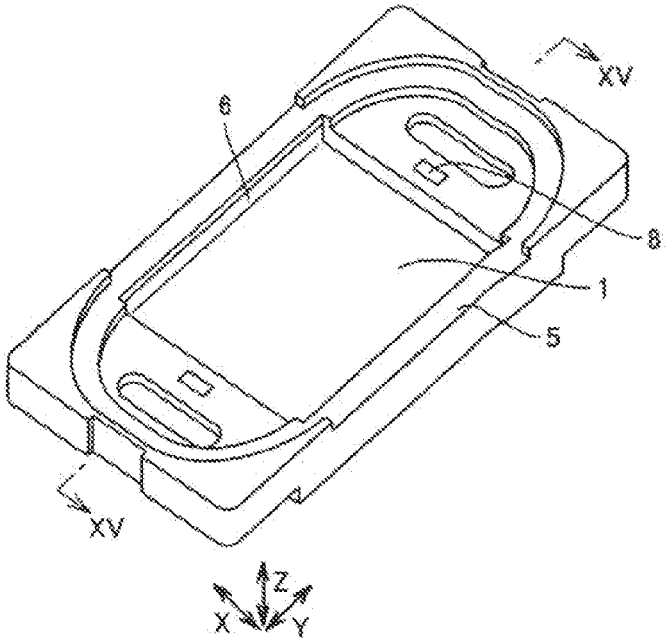
FIG. 14 is a schematic perspective view of the yoke and a frame of the speaker unit in the second embodiment.
Figure 15:
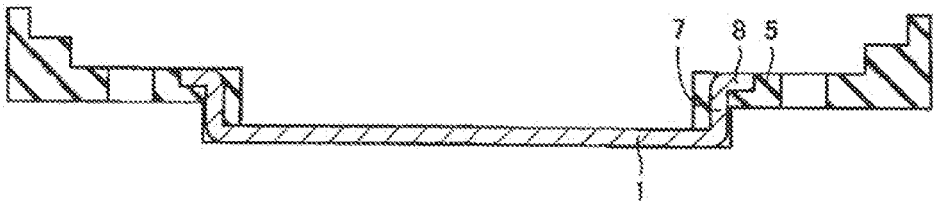
FIG. 15 is a schematic cross section of the yoke and the frame of the speaker unit in the second embodiment.
Figure 16:
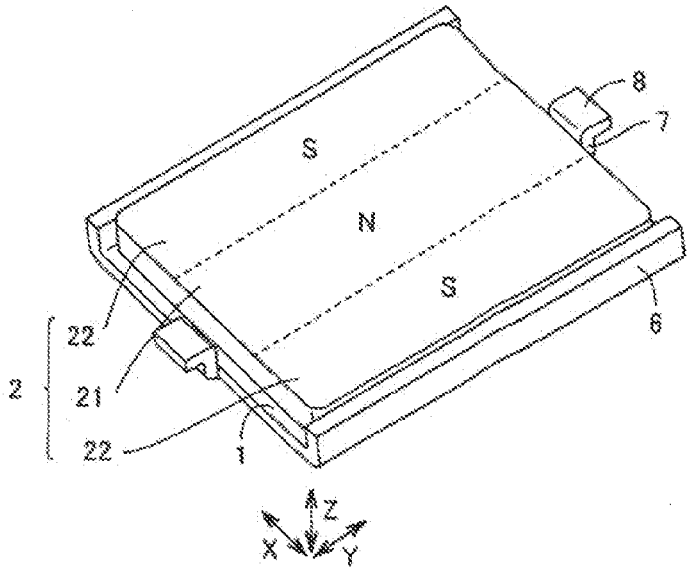
FIG. 16 is a schematic perspective view of the yoke and a magnet member of the speaker unit in the second embodiment.
Figure 17:
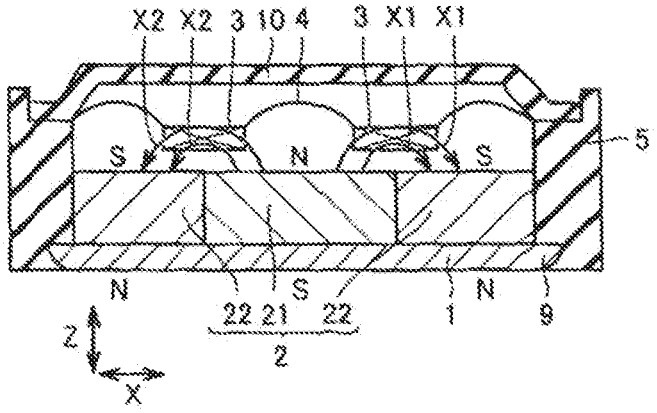
FIG. 17 is a schematic cross section of a speaker unit in a third embodiment.
Figure 18:
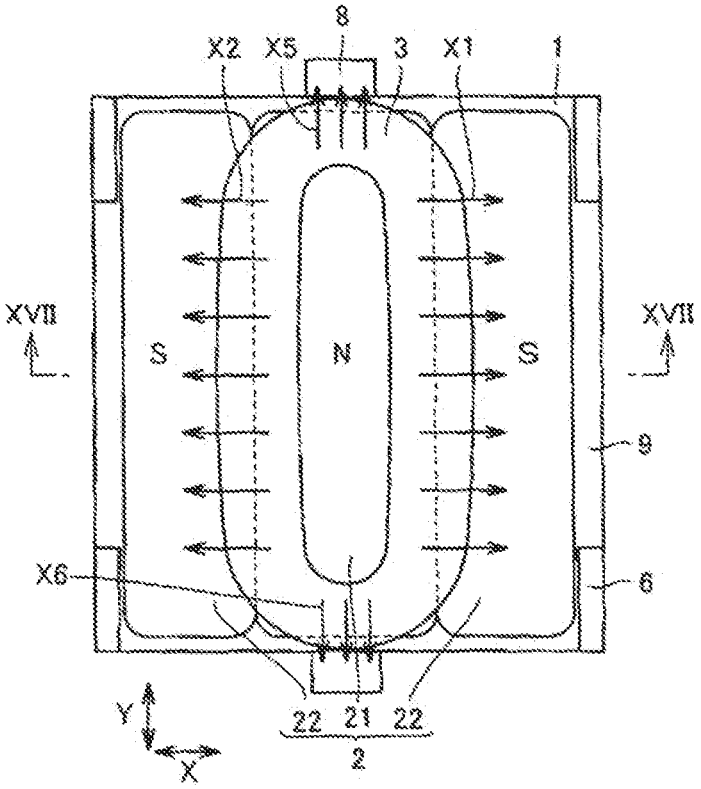
FIG. 18 is a schematic plan view of the speaker unit in the third embodiment.
Figure 19:
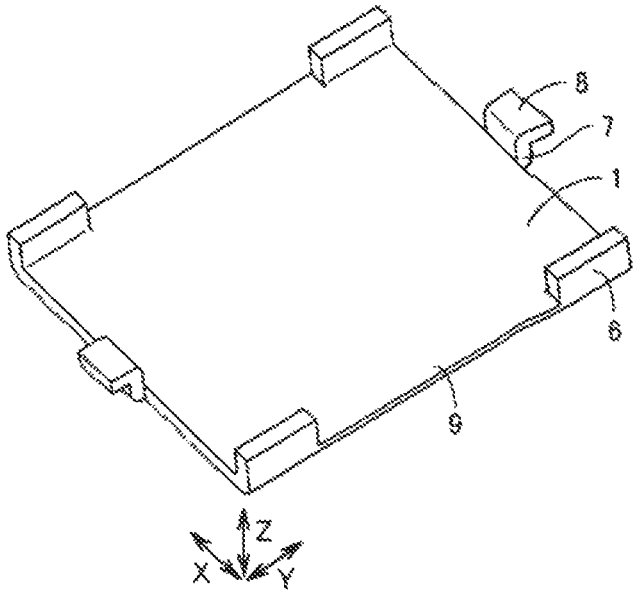
FIG. 19 is a schematic perspective view of a yoke of the speaker unit in the third embodiment.
Figure 20:
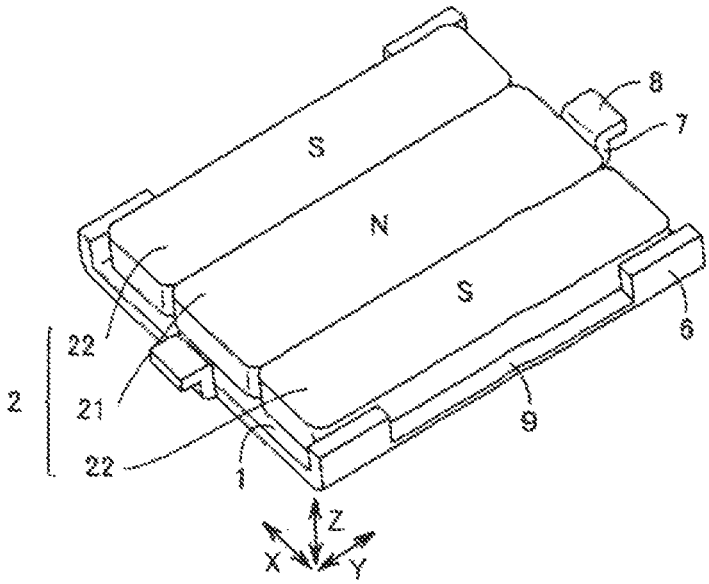
FIG. 20 is a schematic perspective view of the yoke and a magnet member of the speaker unit in the third embodiment.
Figure 21:
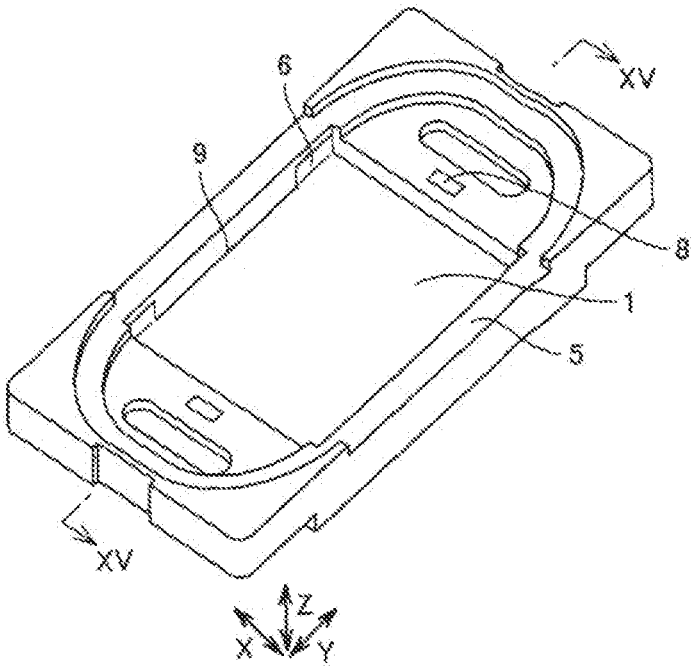
FIG. 21 is a schematic perspective view of the yoke and a frame of the speaker unit in the third embodiment.
Figure 22:
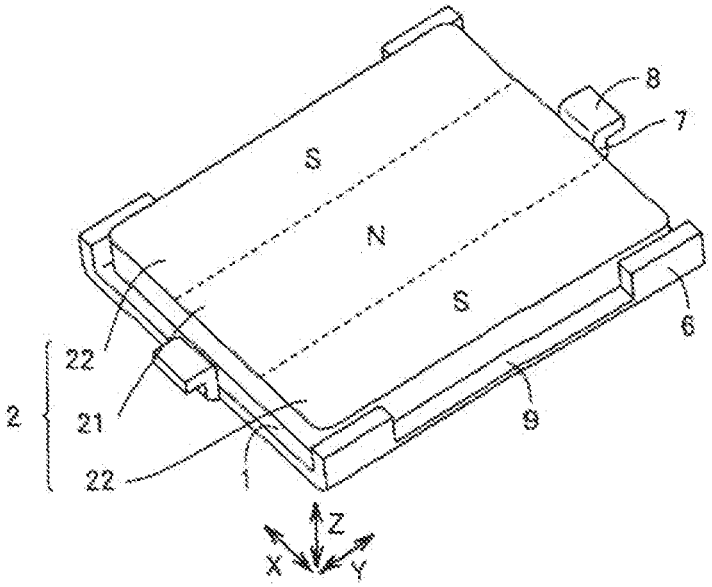
FIG. 22 is a schematic perspective view of the yoke and a magnet member of the speaker unit in the third embodiment.
Figure 23:
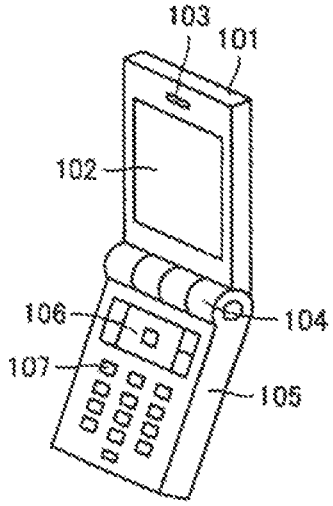
FIG. 23 is a schematic perspective view of a portable information terminal in a fourth embodiment.
Figure 24:
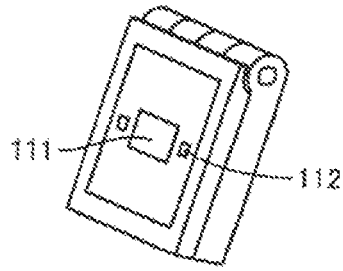
FIG. 24 is a schematic perspective view of the portable information terminal in the fourth embodiment.

1 yoke; 2 magnet member; 3 coil; 4 diaphragm; 5 frame; 6 protrusion; 7 engagement protrusion; 8 bent portion; 9 recess; 10 frame cover; 21 central portion; 22 opposite end portions; 101 upper casing; 102 display unit; 103, 112 sound emission hole; 104 hinge portion; 105 lower casing; 106 operation button; 107 numeric button; 111 display unit

The invention claimed is:

1. A speaker unit comprising:

a yoke which has a rectangular outline as seen in a plan view;

a magnet member having a lower surface placed on said yoke and an upper surface magnetized with an N pole and an S pole aligned in one direction;

a coil which is placed above and spaced from said upper surface of said magnet member, and extending across a boundary between said N pole and said S pole on said upper surface of said magnet;

a diaphragm which is attached to said coil; and a frame which supports said diaphragm, wherein an engagement protrusion which allows said frame and said yoke to engage with each other is provided on a side which is one of sides defining said rectangular outline of said yoke and extends along said one direction.

2. The speaker unit according to claim 1, wherein said engagement protrusion has a bent portion with its leading end bent outward to extend parallel to the upper surface of the magnet and away from said magnet.

3. The speaker unit according to claim 1, wherein said yoke has a protrusion on a side which is one of the sides defining said rectangular outline of said yoke and crosses said one direction, and said protrusion has a recess on a central portion on the side which crosses said one direction.

4. The speaker unit according to claim 1, wherein said magnet member is made up of a plurality of magnetic bodies including a first magnetic body having an upper surface magnetized to an N pole and a second magnetic body having an upper surface magnetized to an S pole, wherein the N and S poles are aligned laterally.

5. The speaker unit according to claim 1, wherein said magnet member is formed of a single magnetic body with an upper surface having an N pole and an S pole.

6. The speaker unit according to claim 1, wherein said coil is one of a rectangle coil, an elliptical coil, a running-track-shaped coil, and a polygonal coil.

7. A portable information terminal comprising a speaker unit as recited in claim 1.

* * * * *